US005096501A

United States Patent [19]

Dishart et al.

[11] Patent Number: 5,096,501

[45] Date of Patent: Mar. 17, 1992

[54] ENVIRONMENTALLY SAFE CLEANING PROCESS AND CLEANING COMPOSITION USEFUL THEREIN

[75] Inventors: Kenneth T. Dishart; David S. Lermond, both of Wilmington, Del.

[73] Assignee: E. I. Du Pont de Nemours & Company, Wilmington, Del.

[21] Appl. No.: 573,602

[22] Filed: Aug. 27, 1990

[51] Int. Cl.[5] ..... B08B 7/04; C23G 1/36; C11D 3/18; C11D 7/24

[52] U.S. Cl. ..... 134/10; 134/40; 252/162; 252/170; 252/173; 252/174.14; 252/174.22

[58] Field of Search ..... 252/174.22, 162, 170, 252/173, 174.19; 134/10, 40

[56] References Cited

U.S. PATENT DOCUMENTS

| | | | |
|---|---|---|---|
| 3,764,265 | 10/1973 | Fijalkowski | 134/10 |
| 4,640,719 | 2/1987 | Hayes et al. | 134/40 |
| 4,673,524 | 6/1987 | Dean | 252/118 |
| 4,780,235 | 10/1988 | Jackson | 252/170 |
| 4,828,709 | 5/1989 | Houser | 134/10 |
| 4,867,800 | 9/1989 | Dishart et al. | 134/40 |
| 4,934,391 | 6/1990 | Futch et al. | 134/40 |

*Primary Examiner*—Prince Willis, Jr.
*Assistant Examiner*—Erin M. Higgins

[57] ABSTRACT

A substrate cleaning process employs a substantially aqueous immiscible cleaning composition and a water rinse followed by phase separation of the cleaning composition and water and reuse of the water.

14 Claims, No Drawings

ENVIRONMENTALLY SAFE CLEANING PROCESS AND CLEANING COMPOSITION USEFUL THEREIN

BACKGROUND OF THE INVENTION

The present invention relates to an environmentally safe cleaning process for removal of contaminants from a substrate surface which employs a water rinse whereby the water is reused. Also the present invention relates to a cleaning composition useful in such process.

A number of patents are directed to removal of contaminants from specific substrate surfaces.

Dean U.S. Pat. No. 4,673,524 discloses a cleaner suitable for cleaning hands and difficulty removable objectionable material such as modern catalyzed auto paint, fast drying printers ink by use of a multicomponent composition containing 25-65% by weight of a dibasic ester admixture of dimethyl succinate, dimethyl glutarate and dimethyl adipate, 5-25% by weight dipropylene glycol methyl ether, 5-25% by weight odorless mineral spirits, 4-9% by weight triethanolamine, 5-15% by weight octylphenoxypolyethoxyethanol, 1-3% by weight nonyl phenol ethoxylate and 8-18% by weight tall oil fatty acid.

Jackson U.S. Pat. No. 4,780,235 discloses a low toxicity paint remover composition containing $C_1$ to $C_4$ dialkyl esters of $C_4$ to $C_6$ aliphatic dibasic acid, an activator, a thickener, a surfactant and at least one other organic nonhalogen-containing solvent.

Hayes et al. U.S. Pat. No. 4,640,719 discloses use of terpene compounds in cleaning printed writing boards. This patent discloses cleaning of residual flux and particularly rosin solder flux and adhesive tape residues employing terpene compounds such as pinene including its alpha and beta isomer, gamma terpinene, delta-3-carene, limonene and dipentene with limonene and dipentene preferred. Dipentene is the racemic mixture of the limonene optically active isomers. This patent further discloses that these terpene compounds are almost completely insoluble in water and cannot be directly flushed away by water. Therefore in a preferred embodiment terpene compounds are combined with one or more emulsifying surfactants capable of emulsifying terpenes with water to facilitate their removal.

Dishart et al. U.S. Pat. No. 4,867,800 discloses cleaning of printed circuit board substrates with a combination of a dibasic ester and terpene.

Futch et al. U.S. Pat. No. 4,934,391 discloses removal of rosin solder flux or resist residues employing a dibasic ester and an emulsifying surfactant. In a distinct embodiment, a combination of terpenes and dibasic esters are disclosed.

With the advent of tightened restrictions on the use of CFCs and chlorocarbon solvents, metal fabricators and other manufacturers are faced with a choice among many options for satisfying their cleaning requirements. These include flammable alcohols, high-flash-point solvents, semi-aqueous cleaners based on terpenes or terpenes/dibasic esters, and aqueous cleaners. Alcohols clean well but are flammable, high-flash-point solvents leave residues which are slow drying, terpenes have undesirably low flash points and objectionable odors, dibasic esters are a poor solvent for oils and greases, and aqueous cleaners are ineffective for removing heavy oils and greases from tight clearances. In addition aqueous and semi-aqueous cleaners pose waste disposal problems unless the soils removed can be effectively separated from the waste water.

A need exists for a semi-aqueous cleaner which is effective for contaminant removal such as oil and grease, biodegradable, low in toxicity, readily separates from rinse water, has a mild odor and high flash point.

SUMMARY OF THE INVENTION

The present invention is directed to a process for removing contaminants from a surface of a substrate comprising the steps of:

(a) applying a cleaning composition to a surface of a first substrate, (b) rinsing the surface of the substrate with water to remove contaminants and the cleaning composition, (c) collecting a combination of the contaminants, cleaning composition and rinse water and allowing the cleaning composition and contaminants to separate from the water, (d) recycling at least a portion of the water from step (c) in a rinsing step onto a second substrate on which cleaning composition has been applied, whereby the cleaning composition comprises (i) a liquid hydrocarbon solvent having a flash point above 100° F., (ii) an emulsifier for the hydrocarbon solvent and (iii) a dibasic ester wherein the cleaning composition is predominantly liquid hydrocarbon solvent on the basis of solvent, emulsifier and dibasic ester and wherein the cleaning composition has an ability to phase separate when mixed with water.

Also the present invention is directed to a cleaning composition which e.g., is particularly useful in cleaning substrates.

DETAILED DESCRIPTION OF THE INVENTION

A key feature of the present invention is an ability to undertake a cleaning process in an environmentally safe manner. The present process allows application of a cleaning composition to a surface of a substrate followed by an aqueous rinse to remove a combination of contaminants and the cleaning composition. The present invention is considered to overcome deficiencies of prior art processes wherein problems are presented in disposal of a cleaning agent and a rinsing material.

The type of substrate employed for contaminant removal is varied. Preferred substrate material include steel, stainless steel, aluminum and its alloys, copper and its alloys, high ferrous alloys such as the Hastelloys, and nickel alloys such as Monel. Also articles made of plastics and glass can be cleaned. In one aspect of the present invention a preferred substrate is a ferrous containing alloy and a cleaning composition may contain a rust inhibitor in addition to other components more fully described below.

Contaminants which are removed from the substrate are varied and include, e.g., heavy and light lubricating oils, metal working fluids (cutting, drawing, or machining oils), greases, buffing or lapping compounds, pitch, high-melting waxes, and particulate contamination and the like.

In the present invention a key aspect is the employment of a specially formulated cleaning composition which is insoluble or substantially insoluble in water so that phase separation readily occurs. In a first step of the present process a cleaning composition is applied to a substrate surface. The manner of application of the cleaning composition is not critical and can involve, e.g., dipping of the substrate into the cleaning composition or spraying of the composition. In a dipping operation some agitation of the cleaning bath is generally desirable such as by submerged liquid jets, mechanical stirring or ultrasonic application.

After the first step in which the cleaning composition is applied to a substrate surface a second step of a water rinse is employed. Thereafter in a third step, a mixture of the cleaning composition, removed contaminant and rinse water are collected in a container. The mixture is allowed to stand wherein phase separation of the cleaning composition and rinse water takes place. Preferably for safety considerations the hydrocarbon fraction will be in droplets suspended in water as the continuous phase rather than water suspended in a hydrocarbon. Time for phase separation is preferably almost immediately such as within one minute. However separating times can be longer such as up to one or three hours with a disadvantage of less throughput. Use of elevated temperature may increase the rate of separation. It is understood that it is within the scope of the invention to employ water with the cleaning composition in the first step in which the cleaning composition is applied to the substrate surface prior to a rinsing step.

The surface contaminant particularly if it is hydrocarbon based will concentrate and collect in the cleaning composition. To avoid buildup of contaminants to unacceptable levels a portion of the cleaning composition should be removed and environmentally disposed, e.g., by burning. In steady state operation of a cleaning process a portion of the cleaning composition can be recycled for use with other substrates. However, it is not necessary for the cleaning composition to be recycled but for economic reasons such recycling is preferred.

In contrast to the cleaning composition, it is necessary for rinse water to be recycled for use in another cleaning step after its phase separation from the cleaning composition. Therefore a closed loop may be employed wherein rinse water is continuously separated from the cleaning composition and continuously reused in a rinsing step.

In the present invention one or more liquid hydrocarbon solvents are used in the cleaning composition. The type of hydrocarbon component useful in the invention may be selected from the broad class of aliphatic and aromatic solvents. The hydrocarbon solvent has an ability to be present as a residue on the surface of the substrate which aids in contaminant removal. Preferred hydrocarbon compounds or blends posses a flash point above 100° F., preferably above 140° F. and more preferably above 200° F. (Tag Closed Cup method) so that they are not classified as flammable liquids. Examples of such hydrocarbon components are the high flash point petroleum derived solvents, such as mineral spirits, naphthas, and aromatics readily available from a variety of suppliers. Specific examples are Exxon "Isopar," Shell "Soltrol" and Ashland "Hi-Sol" solvents. A highly preferred class of hydrocarbon solvents is aliphatic. Although a hydrocarbon solvent can include terpene, a preferred class excludes a terpene hydrocarbon.

In addition to the hydrocarbon solvent at least one emulsifier is employed. A preferred emulsifier is a nonionic surface active agent, i.e., a surfactant which functions to facilitate the emulsification of the hydrocarbon solvent in the water rinsing step. The emulsifier is chosen to have enough emulsifying power to promote rinsing without formation of a stable emulsion. This feature is important since one of the primary advantages of the cleaning composition is its ability to separate into a second layer on the surface of the rinse water, taking with it the contaminants removed from the cleaned articles. This simplifies recycle of the water. Examples of such surfactants are nonionic alcohol ethoxylates, where the alcohol is primary or secondary and has from 8 to 20 carbon units in the chain which can be linear or branched, and where the average number of ethoxylate groups is from 1 to 7.

In the present invention a dibasic ester or combination of dibasic ester solvents is employed. Dibasic ester is employed in its normal definition and includes typical dialkyl esters of dicarboxylic acids (dibasic acids) capable of undergoing reactions of the ester group, such as hydrolysis and saponification. Conventionally at low and high pH they can be hydrolyzed to their corresponding alcohols and dibasic acids or acid salts. Preferred dibasic ester solvents are: dimethyl adipate, dimethyl gluterate and dimethyl succinate and mixtures thereof. Other esters with longer chain alkyl groups derived from alcohols, such as ethyl, propyl, isopropyl, butyl and amyl and mixtures thereof including methyl can be employed. Also the acid portion of these esters can be derived from other lower and higher molecular weight dibasic acids, such as oxalic, malonic, pimelic, suberic, and azelaic acids and mixtures thereof including the preferred dibasic acids. These and other esters can be employed provided they are soluble with the hydrocarbon solvent and are not classified as flammable liquids (Flash Point at or above 100° F. by Tag Closed Cup method and more preferably above 140° F.).

Although the above class of dibasic esters provide operability in contaminant removal, it is highly preferable that the dibasic ester comprises di-isobutyl dibasic ester. Such ester has been found to be particularly effective in allowing phase separation to occur in a short time period and such ester has been found to be more effective for oil and grease removal than, for example, dimethyl dibasic ester. Generally the dibasic ester will have a solubility in water of not greater than 2% by weight at a temperature of 25° C.

In the cleaning composition the liquid hydrocarbon solvent will be present in a predominant amount on the basis of the hydrocarbon solvent, emulsifier and dibasic ester. A suitable concentration on the basis of these three components is in an amount of 51 to 95% by weight of hydrocarbon solvent. A preferred range is 70 to 90% with a more preferred range of 80 to 90%. The emulsifier can be present in a relatively low amount such as a range of 1 to 25% with a preferred and a more preferred range of 3 to 15% and 5 to 12%. The dibasic ester is likewise present in a relatively minor amount such as in a range of 1 to 25%. Preferred and more preferred ranges are 1 to 15% and 1 to 8%.

An optional component in the cleaning composition is a rust inhibitor. Oil or grease on a ferrous containing surface such as mild steel surface protects the substrate from corrosion and it is removed in a cleaning step. However a freshly cleaned steel surface in contact with water will rust rapidly and a water rinse step provides ideal conditions for flash rusting. The problem has been less severe in the prior art since many cleaners are alkaline. Although rust inhibitors (also called preventatives) can be added to rinse water, inclusion of a rust inhibitor in the cleaning composition itself is desirable.

Rust inhibitors function by leaving a protective film on the surface of a metal. While oily and dry-film inhibitors are useful, an oil film is effective in preventing rust but can be undesirable on many finished products or parts that will subsequently be coated, brazed, or welded. Common dry-film inhibitors which are water soluble are not generally preferred in the present invention since they can concentrate in the rinse water.

Alkylamine salts of alkyl phosphates are oil soluble and form a dry rust inhibiting film on metal surfaces. These products were developed for use in motor fuels and are preferred. They may be incorporated into the cleaning composition to provide the desired rust protection in the presence of water.

An example of an inhibitor is an amine-neutralized alkyl phosphate or alkylamino alkylphosphate. A preferred inhibitor is the salt of an alkyl primary amine, where the alkyl group is a tertiary alkyl group containing 14 to 16 carbon atoms, with mixed mono- and di-isooctyl phosphates. An illustrative amine is available from Rhom and Haas under the name "Primene" 81-R. Other examples are (a) salts of 2-ethylhexylamine with alkyl phosphates and (b) salts of various alkylamines with butyl phosphate, tridecyl phosphate, 2ethylhexyl phosphate, phenyl phosphate, and octylphenyl phosphate.

To illustrate the present invention the following examples are provided. All parts and percentages are by weight unless otherwise indicated.

EXAMPLE 1

A steel ball bearing was packed with 1.10 grams of Shell Alvania Grease No. 2, a high-filler universal grease of No. 2 consistency. The ball bearing used was 1½ inches in outside diameter and contained a total of 22 balls, 3/16 inch in diameter in two races. The bearing was suspended for 15 minutes in 600 ml of a room-temperature paraffinic/naphthenic hydrocarbon solvent stirred by an agitator turning at 450 rpm in a 1000-ml beaker. The hydrocarbon solvent was identified as follows:

| | |
|---|---|
| Boiling Range, °F. | 400–441 |
| Composition, wt. % | |
| Cycloparaffins | 69 |
| Isoparaffins | 29 |
| n-Paraffins | 2 |
| Aromatics | 0.008 |
| Flash Point, Tag Closed Cup, °F. | 159 |

After cleaning, the bearing was dried to constant weight in a vacuum oven at 130° C. In a separate experiment, the weight loss of the grease alone was found to be insignificant under these drying conditions. The final weight of the bearing indicated that 56.4 percent of the grease had been removed.

The experiment was repeated using a second identical bearing packed with 1.10 grams of the same grease suspended in 600 ml of the same hydrocarbon containing 10 weight percent of a non-ionic surfactant designated Merpol ®SE. The bearing was then suspended for two minutes in a 2000-ml beaker containing 1000 ml of distilled water maintained at 50° C. and stirred by an agitator turning at 450 rpm. After drying to constant weight, 68.2 percent of the grease was found to have been removed.

A third identical packed bearing was cleaned using the same procedure in 600 ml of hydrocarbon containing 9.5 weight percent of a non-ionic surfactant designated Tergitol 15-S-3 plus 5.0 weight percent of the mixed diisobutyl esters of succinic, glutaric, and adipic acids. After a two-minute water rinse at 50° C., the weight of the dried bearing indicated that 81.8 percent of the initial grease had been removed.

A heavy grease was removed from a ball bearing faster when cleaned with a high-flash-point hydrocarbon containing Merpol ®SE and rinsed with water than by cleaning with either the hydrocarbon or water alone. Cleaning was further improved by use of "Tergitol" 15-S-3 instead of Merpol ®SE and addition of di-isobutyl DBE.

EXAMPLE 2

A small metal assembly was prepared by hand tightening three nuts, separated by three washers, on a ¼"×2" bolt. The assembly was dipped for 15 seconds in Rust Lick "Cutzol" 711 cutting oil and allowed to drain for 15 seconds. The assembly was then suspended for one minute in 600 ml of a room-temperature paraffinic/-naphthenic hydrocarbon solvent having a flash point of 159° F. (identified in Example 1) stirred by an agitator turning at 450 rpm in a 1000-ml beaker. After cleaning, the assembly was found to be coated with the high-boiling hydrocarbon solvent. The cutting oil remaining on the assembly was extracted by immersion in 75.0 ml of 1,1,2-trichloro-1,2,2-trifluoroethane for about an hour. A second extract was prepared by extracting an assembly that had been dipped in oil but not cleaning. A blank was prepared by extracting a clean assembly that had been subjected to the same cleaning agent and procedure. The percent oil remaining on the cleaned bearing was calculated by comparing the absorbance, measured at 232 nm, of the extract from the cleaned bearing versus the absorbance of the extract from the uncleaned bearing. The absorbance of the blank was found to be insignificant. The ratio of the absorbances indicated that the cleaning procedure removed 98.4 percent of the oil.

The experiment was repeated using a second identical assembly dipped in the same oil suspended in 600 ml of the same hydrocarbon containing 9.5% of a nonionic surfactant designated Tergitol 15-S-3 plus 5.0 weight percent of the mixed di-isobutyl esters of succinic, glutaric, and adipic acids. The bearing was then suspended in a 2000-ml beaker containing 1000 ml of distilled water maintained at 50° C. and stirred by an agitator turning at 450 rpm. After the rinsing step, the assembly was found to be essentially free of the cleaning agent. Using the same extraction technique, no detectable cutting oil was found on the cleaned assembly.

The experiment was again repeated using a third identical assembly dipped in the same oil suspended in 600 ml of a paraffinic/naphthenic hydrocarbon solvent and containing 9.5% of a non-ionic surfactant designated Tergitol 15-S-3 and 5.0 weight percent of the mixed diisobutyl esters of succinic, glutaric, and adipic acids. The hydrocarbon solvent was identified as follows:

| | |
|---|---|
| Boiling Range, °F. | 421–578 |
| Composition, wt. % | |
| Cycloparaffins | 55 |
| Isoparaffins | 37 |
| n-Paraffins | 8 |
| Aromatics | 0.250 |
| Flash Point, Tag Closed Cup, °F. | 201 |

After cleaning in the hydrocarbon mixture, the bearing was suspended in a 2000-ml beaker containing 1000 ml of distilled water maintained at 50° C. and stirred by an agitator turning at 450 rpm. After the rinsing step, the assembly was found to be essentially free of the cleaning agent. Using the same extraction technique, the cleaning procedure was found to have removed 99.8 percent of the oil.

Therefore it is concluded when a high-flash-point hydrocarbon is used to remove cutting oil from a small metal assembly, an undesirable residue of non-volatile hydrocarbon remains on the cleaned parts. Addition of "Tergitol" 15-S-3 and di-isobutyl DBE to the hydrocarbon and the use of a water rinse avoids the residue and improves oil removal.

EXAMPLE 3

Test coupons, approximately 2"×1¼"×1/32" thick, were cut from a single mild steel plate. Each coupon was polished with abrasive, rubbed with a clean cloth to remove metal fines, rinsed in 1,1,2-trichloro1,2,2-trifluoroethane, and stored in a desiccator until ready for use.

The following cleaning agent formulations were prepared: (A) 9.5% Tergitol 15-S-3, 5.0% mixed diisobutyl esters of succinic, glutaric, and adipic acids, and 85.5% paraffinic/naphthenic hydrocarbon of flash point 159° F.; and (B) 9.5% Tergitol 15-S-3, 5.0% mixed di-isobutyl esters of succinic, glutaric, and adipic acids, and 85.5% paraffinic/naphthenic hydrocarbon of flash point 201° F. The hydrocarbons are identified in Examples 1 and 2.

In each test, one of the prepared coupons was removed from the desiccator and suspended for one minute in 500 ml of cleaning agent maintained at 50° C. in a 1000-ml agitated beaker. To simulate a water rinse step, the coupon was then suspended for five minutes in a second 1000-ml agitated beaker containing 500 ml of an emulsion maintained at 50° C. which had been prepared by adding 50 ml of cleaning agent to 450 ml of distilled water. The coupon was then allowed to dry in the air and observed for rusting.

The following were evaluated as rust preventative additives to the cleaning agent formulations: (I) 2ethylhexylamine salt of tridecylphosphate and (II) "Primene" 81-R salt of isooctyl phosphate. "Primene" 81-R is the commercial name for $R\text{-}C(CH_3)_2\text{-}NH_2$ where $R=C_{12}\text{-}C_{14}$.

The following results were obtained:

| Cleaning Agent Formulation | Additive | Additive Concentration, Weight % | Observations of Rusting |
|---|---|---|---|
| A | None | — | 25% rust after emulsion rinse |
| A | I | 1.0 | Slight trace rust after emulsion rinse |
| A | I | 3.0 | Very slight trace rust after emulsion rinse |
| A | II | 1.0 | No rust after emulsion rinse |
| A | II | 3.0 | No rust after emulsion rinse |
| B | II | 1.0 | No rust after emulsion rinse No rust after 10 hours |

Therefore it is concluded that addition of alkylamine salts of alkyl phosphates to the semi-aqueous formulation prevents flash rusting of steel during water rising. These compounds are rust inhibitors.

EXAMPLE 4

The time required for a stagnant cleaning agent-in-water emulsion to separate into a solvent-rich and a water-rich layer was measured by recording the position of the interface between the two layers as the emulsion was allowed to settle. Emulsions were prepared by adding 90 ml of distilled water and 10 ml of cleaning agent to a 4-oz capacity bottle and immersing the bottle in a constant-temperature bath. After reaching thermal equilibrium, the bottle was withdrawn from the bath and shaken vigorously for one minute. The contents were immediately poured into a 100-ml graduated cylinder which had been pre-heated in the constant-temperature bath. The cylinder was returned to the bath and the position of the interface recorded versus time. The time for complete settling was taken as the time required for the interface position to become steady as determined from a graph of its location versus time.

The settling time for a cleaning agent consisting of 90 weight percent paraffinic/naphthenic hydrocarbon with a flash point of 159° F. (identified in Example 1) and 10.0 weight percent Tergitol 15-S-3 was found to be a function of temperature. At about 25° C., the interface position was still changing after 8 hours. At 40° C., 60° C., and 70° C., the times for complete settling were 3.5 hours, 1.5 hours, and 1.0 respectively. At a temperature of 60° C., various additives were found to effect settling rate. In these experiments, the formulation was modified by replacing some of the hydrocarbon with the additives while keeping the concentration of Tergitol 15-S-3 constant. Addition of 4.5 weight percent of the mixed di-isobutyl esters of succinic, glutaric, and adipic acids was found to reduce settling time from 1.5 hour to 15 minutes. Addition of 9.0 weight percent of the mixed dimethyl esters of the same acids reduced settling time to only about 50 minutes. Addition of 4.5 weight percent of either the acetate of $C_9$ Or of $C_{10}$ Oxo alcohol did not reduce settling time below the 1.5 hours measured for the hydrocarbon and Tergitol 15-S-3 alone.

The additives tested as corrosion inhibitors in Example 3 were also found to affect settling rate. The formulation consisting of 9.5 weight percent Tergitol 15-S-3, 5.0 weight percent of the mixed di-isobutyl esters of succinic, glutaric, and adipic acids, and 85.5 weight percent of the paraffinic/naphthenic hydrocarbon having a flash point 159° F. had a settling time of 15 minutes at 60° C. Addition of 1.0 weight percent of Additive I increased settling time to 1.0 hour while addition of 1.0 weight percent of Additive II reduced settling time to less than one minute. When the formulation was changed by substituting a paraffinic/naphthenic hydrocarbon having a flash point of 201° F. (identified in Example 2), addition of 1.0 weight percent of Additive II also reduced the settling time from 15 minutes to less than one minute at 60° C.

Therefore the separation of emulsions formed when water rinsing semi-aqueous formulations containing "Tergitol" 15-S-3 is faster at higher temperatures. Separation is also improved by the addition of diisobutyl DBE. Two Other esters, acetates of $C_9$ and $C_{10}$ primary alcohols, were operative in cleaning and in phase separation but they performed substantially less effectively than the addition of isobutyl dibasic ester. Additive II rust inhibitor was found to improve separation, but Additive I alkylamino alkylphosphate inhibitor was found to result in slower separation.

What is claimed is:

1. A process for removing contaminates from a surface of a substrate comprising the steps of:

(a) applying a cleaning composition to a surface of a first substrate, (b) rinsing the surface of the substrate with water to remove the cleaning composition, (c) collecting a combination of the contaminates, cleaning composition and rinse water and allowing the cleaning composition which contains contaminates to separate from the water, (d) recycling at least a portion of the water from step (c) in a rinsing step onto a second substrate on which cleaning composition has been applied, whereby the cleaning composition consists essentially of a liquid hydrocarbon solvent having a flash point above 100° F., an emulsifier for the solvent and dibasic ester wherein the cleaning composition is predominantly liquid hydrocarbon solvent on the basis of solvent, emulsifier and dibasic ester and wherein the cleaning composition has an ability to phase separate when mixed with water, wherein said solvent, emulsifier and dibasic ester are at least substantially insoluble in water which results in separating from water in step c.

2. The process of claim 1 wherein terpene is excluded from the definition of liquid hydrocarbon solvent.

3. The process of claim 2 wherein the liquid hydrocarbon solvent is aliphatic.

4. The process of claim 1 wherein the dibasic ester comprises di-isobutyl dibasic ester.

5. The process of claim 3 wherein the dibasic ester comprises di-isobutyl dibasic ester.

6. The process of claim 1 wherein water is substantially absent from the cleaning composition in step (a).

7. The process of claim 1 wherein water is present with the cleaning composition in step (a).

8. The process of claim 1 wherein the composition contains by weight on the basis of liquid hydrocarbon solvent, emulsifier and dibasic ester (i) liquid hydrocarbon solvent in an amount of from 51 to 95%;

(ii) emulsifier in an amount of from 1 to 25%;

(iii) dibasic ester in an amount of from 1 to 25%.

9. The process of claim 8 wherein (i) is present in an amount of from 80 to 90%;

(ii) is present in an amount of from 5 to 12%;

(iii) is present in an amount of from 1 to 8%.

10. The process of claim 6 wherein the dibasic ester comprises di-isobutyl dibasic ester.

11. The process of claim 1 wherein the substrate is metal.

12. The process of claim 11 wherein the contaminant is oil or grease.

13. The process of claim 1 wherein the substrate is ferrous and the cleaning composition contains a rust inhibitor.

14. The process of claim 1 wherein at least a portion of the cleaning composition after step (c) is incinerated.

* * * * *